United States Patent [19]

Sefko et al.

[11] 4,447,795

[45] May 8, 1984

[54] LAMINATED GRID AND WEB MAGNETIC CORES

[75] Inventors: John Sefko, Monroeville; Norman M. Pavlik, Plum Borough, both of Pa.

[73] Assignee: The United States of America as represented by the United States Department of Energy, Washington, D.C.

[21] Appl. No.: 260,635

[22] Filed: May 5, 1981

[51] Int. Cl.[3] ..... H01F 17/06

[52] U.S. Cl. ..... 336/178; 336/172; 336/212; 336/234

[58] Field of Search ..... 336/178, 172, 212, 234

[56] References Cited

U.S. PATENT DOCUMENTS

| | | | |
|---|---|---|---|
| 1,859,115 | 5/1932 | Summers | 336/178 X |
| 2,664,541 | 12/1953 | Henderson | 323/45 |
| 3,077,570 | 2/1963 | Popa | 336/61 |
| 3,624,575 | 11/1971 | Muller et al. | 336/234 X |
| 3,624,576 | 11/1971 | Rauter | 336/234 X |

FOREIGN PATENT DOCUMENTS

| | | | |
|---|---|---|---|
| 7415784 | 5/1975 | Netherlands | 336/178 |

*Primary Examiner*—J. V. Truhe
*Assistant Examiner*—Susan Steward
*Attorney, Agent, or Firm*—L. P. Johns

[57] ABSTRACT

A laminated magnetic core characterized by an electromagnetic core having core legs which comprise elongated apertures and edge notches disposed transversely to the longitudinal axis of the legs, such as high reluctance cores with linear magnetization characteristics for high voltage shunt reactors. In one embodiment the apertures include compact bodies of microlaminations for more flexibility and control in adjusting permeability and/or core reluctance.

11 Claims, 13 Drawing Figures

DC HYSTERESIS LOOP, LAMINATED GRID CORE

DC HYSTERESIS LOOP OF MODIFIED WEB CORE (NOTCHED)

LAMINATED GRID AND WEB MAGNETIC CORES

GOVERNMENT CLAUSE

The United States has rights in this invention pursuant to Contract No. De-AC-01-78-ET-29073 between the U.S. Department of Energy and Westinghouse Electric Corporation.

BACKGROUND OF THE INVENTION

1. Field of the Invention

This invention relates to laminated grid and webbed magnetic cores and, more particularly, it pertains to high reluctance core legs, such as high voltage shunt reactors or other electromagnetic devices, that require linear magnetization characteristics.

2. Description of the Prior Art

The function of a shunt reactor is to provide the required inductive compensation necessary for line voltage control and stability in high voltage transmission lines. The prime requisites of a reactor are to sustain and manage high voltage (about 700 kV) and to provide a constant inductance over a range of operating inductions. Simultaneously, the reactors are to have low profile in size and weight, low losses, low vibration and noise, and sound structural strength.

Current conventional shunt reactors are constructed in a manner similar to the core type power transformers in that both use high permeability low loss grain oriented electrical steel in the yoke sections of the cores. However, they differ markedly in that shunt reactors must provide constant inductance over a range of operating inductions. In conventional high voltage shunt reactors, this is accomplished by use of a number of large air gaps in the leg sections of the reactor core. Typically, the high reluctance legs consist of approximately one inch of air gap followed alternatively by one inch of electrical steel. In current practice, the iron or ferromagnetic sections of the high reluctance core are constructed by cutting and assembling electrical steel strips into what resembles a multi-spoke wheel. Such sections are difficult to construct because of the requirement to utilize progressively smaller strips as building proceeds from the center to the circumference of the section. The design is complicated further by space factor and bonding strength requirements.

The core legs are constructed by alternating the "wheels" with ceramic spacers to provide the required air gap and to provide an integrated structure. An example of a reactor leg consists of 18" of iron "wheels" followed alternatively by 18" of air gap (ceramic discs). This design has high losses due to leakage flux impinging on the iron at an angle somewhat normal to the plane of the lamination strips. Because of $B^2A$ forces at the air gaps, high amplitude vibrations produce high noise levels. This structure is difficult to construct and assemble due to the large number of strips that must be stacked on end into the wheel design. Since the structure uses ceramic inserts as spacers for air gaps, this tends to produce a weakened structure.

Another example of conventional shunt reactors is the all air gap reactor. This reactor has the advantage of having perfectly constant inductance and consequently has a constant derivative of voltage with respect to current, i.e., $\Delta E/\Delta I$=constant. A marked disadvantage to this design is the low permeability of the reactor, the permeability being equal to that of space which is equal to one gauss/oersted, or unity. This means that for a given inductance this design will by necessity have a size two or three times that of an iron-air gap reactor. In addition, due to the low circuit permeance, stray eddy current losses, particularly in the windings, will be exceedingly high compared to the iron air gap designs.

SUMMARY OF THE INVENTION

In accordance with this invention, it has been found that a laminated magnetic core may be provided from that which comprises upper and lower spaced core yokes, core legs disposed between the core yokes, each core yoke and core leg being comprised of stacked laminations of magnetic material, each leg including opposite edge walls and opposite web side walls extending between upper and lower core yokes, the web side walls having opening means comprising elongated apertures and leg notches, the apertures having longitudinal axis disposed transversely to the vertical axis of the core legs, the apertures being disposed in vertically spaced horizontal zones of each other with transverse web side wall portions therebetween, said side wall portions extending between opposite side walls; the notches extending from the side walls and into the web side walls between apertures and the elongated apertures having opposite extremities aligned in planes spaced inwardly from the corresponding edge walls, the notches extending partially between adjacent pairs of apertures, and the opening means also comprising a plurality of spaced elongated slits in the web side wall portions between each adjacent pair of apertures to dispel eddy currents, and the elongated slits being aligned with the corresponding notches.

The device of this invention relates to a new design concept for magnetic cores for the high reluctance leg sections of high voltage shunt reactors or to other electromagnetic devices that require linear magnetization characteristics. The various embodiments of this invention, in aggregate, provide in shunt reactors (and similar devices) the advantages of (1) improved structural integrity, (2) less vibration and noise, (3) lower losses, and (4) smaller mass and profile.

DESCRIPTION OF THE PREFERRED EMBODIMENTS

Figure 1:
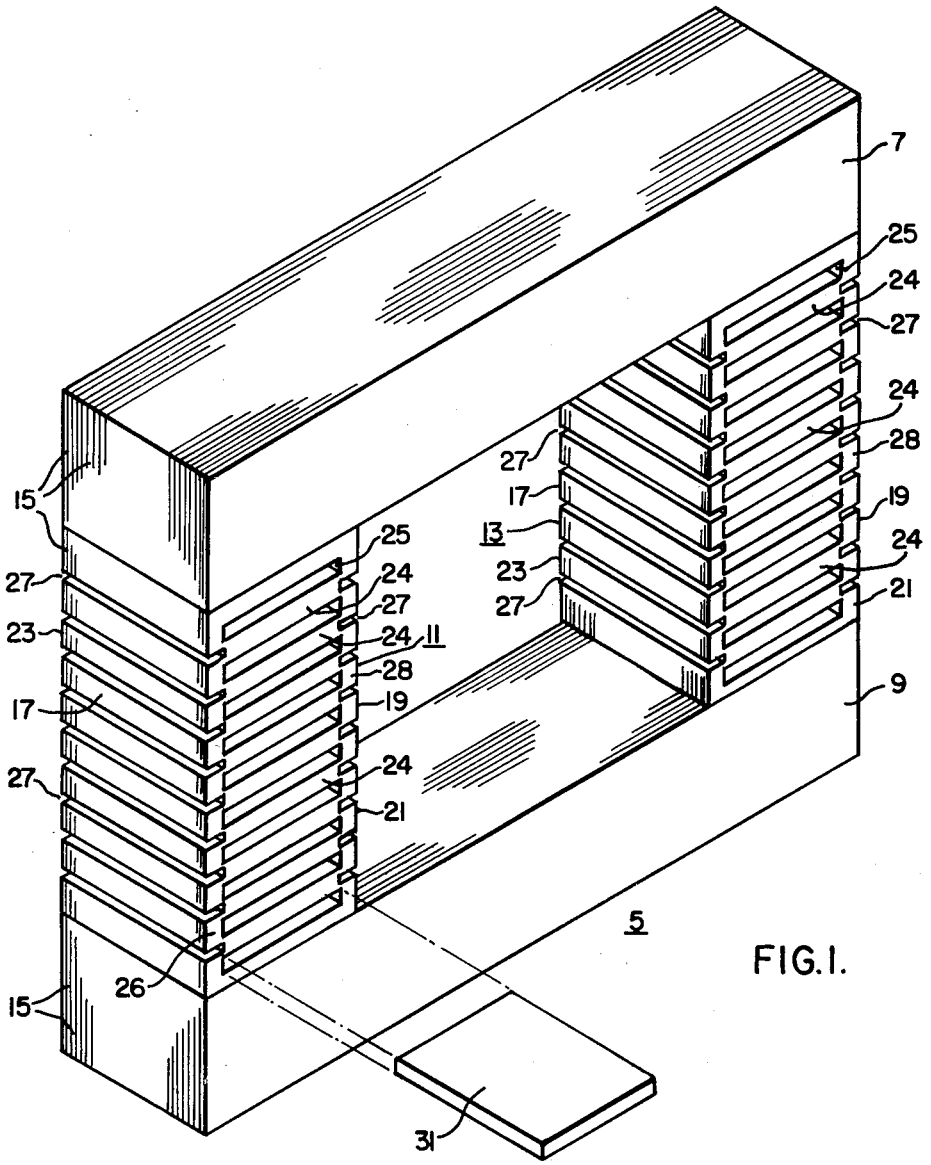
FIG. 1 is an isometric view of a magnetic core showing the laminated legs in accordance with this invention.

In FIG. 1, a magnetic core is generally indicated at 5 and it comprises an upper yoke 7, a lower yoke 9, and a pair of spaced legs 11 and 13, extending between the yokes. Both yokes 7, 9 and legs 11, 13 are comprised of a plurality of laminations 15 of magnetic metal, such as ferromagnetic alloy in a conventional manner, for example, silicon iron electrical steels.

Each leg 11, 13 includes similar opposite edge walls 17, 19, the latter of which is not shown and is parallel to the former. Each leg also comprises similar opposite web side walls 21, 23 of which the latter is not shown in parallel to the former.

Figure 2:
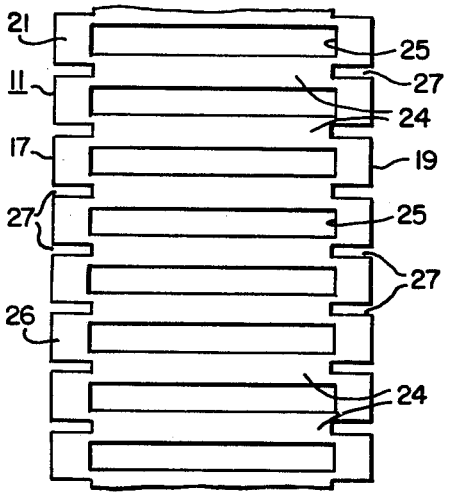
FIG. 2 is a fragmentary elevational view of the laminated structure of FIG. 1.

The legs 11, 13 are provided with opening means including elongated apertures 25 and edge notches 27. The notches 27 (FIG. 1) extend between the web side walls 21, 23 along the edge walls 17, 19. In FIG. 2, the ribs 24 extend transversely between vertical webs 26, 28. The notches 27 are disposed in the webs 26, 28 between the apertures 25 and aligned with ribs 24. The apertures 25 are preferably elongated rectangular openings which, like the notches 27, extend through the laminations 15 between the web side walls 21, 23. The apertures 25 are vertically spaced and in horizontal zones of each other with their longitudinal axes extending transversely to the vertical axis of the leg 11. Corresponding opposite ends of the several apertures 25 are preferably aligned and in a plane spaced inwardly from and parallel to the adjacent edge walls 17, 19.

Figure 3:
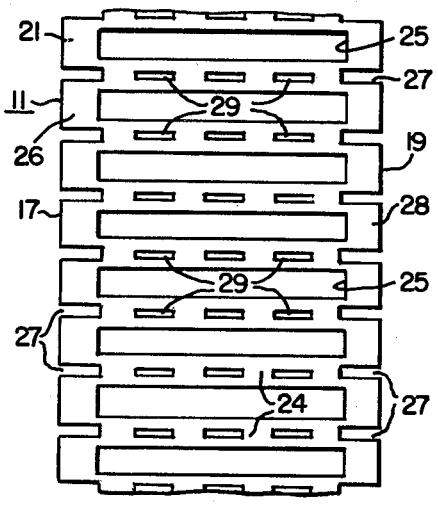
FIG. 3 is a fragmentary elevational view of the leg construction of another embodiment.

Another embodiment of the invention is shown in FIG. 3 in which similar numerals refer to similar parts as previously described. The opening means (FIG. 3) includes the apertures 25 and notches 27 in the edge walls 17 and 19. The opening means also includes spaced elongated slits 29 in the horizontal ribs 24 between spaced apertures 25. The slits 29 are preferably in alignment with and between edge notches 27. Moreover, the longitudinal axes of the slits 29 are substantially parallel to the longitudinal axes of the adjacent apertures 25 and extend transversely to the vertical axis of the leg 21.

In accordance with this invention, the slits 29 serve the purpose of dispelling or minimizing the effects of eddy currents which would otherwise occur along opposite edges of the legs 21, 23 where the slits are provided. The elongated slits 29 also serve to minimize and avoid eddy currents in the web side wall 21 between the apertures 25.

Figure 4:
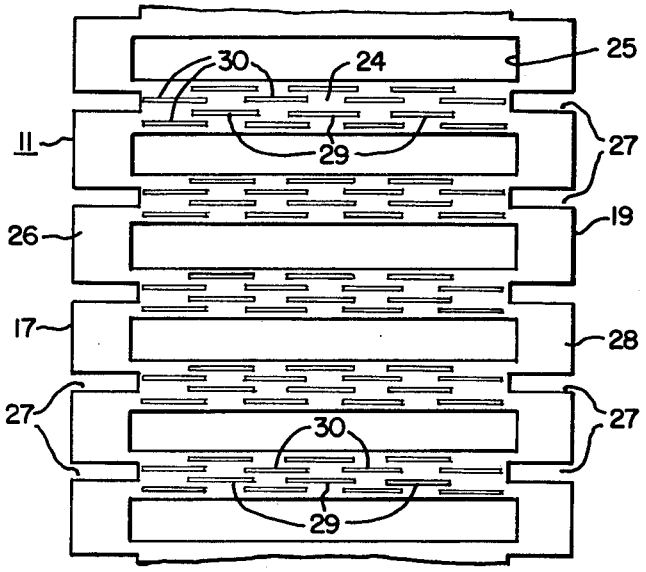
FIG. 4 is a fragmentary elevational view of a laminated structure of another embodiment.

Another embodiment of the invention is that shown in FIG. 4. In addition to the slits 29, this embodiment includes slits 30 in the ribs 24. The slits 30 are disposed in rows above and below the slits 29, and alternately overlap the slits 29 of adjacent rows, so that the flux in the plane of the lamination must cross the air gaps of the slits.

In the foregoing embodiments, the opening means including the apertures 25, the edge notches 27, and the slits 29, 30 are adjusted in magnitude to give increased permeability and yield linear characteristics.

In another embodiment of this invention, the opening means, such as the apertures 25, are filled with microlaminations, such as indicated by a formed body 31 (FIG. 1). Other bodies of appropriate size may be inserted into the edge notches 27 and the slits 29, 30.

Figure 5:
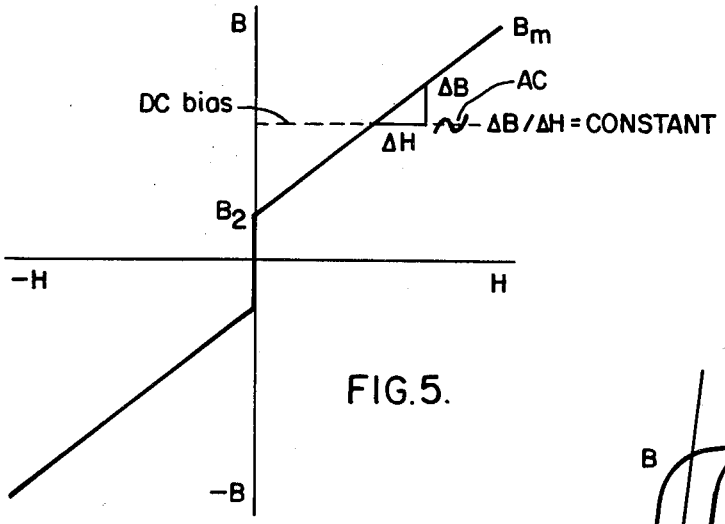
FIG. 5 is a graph of induction-magnetizing force characteristics of a magnetic core leg of the prior art structure of FIG. 6.
Figure 6:
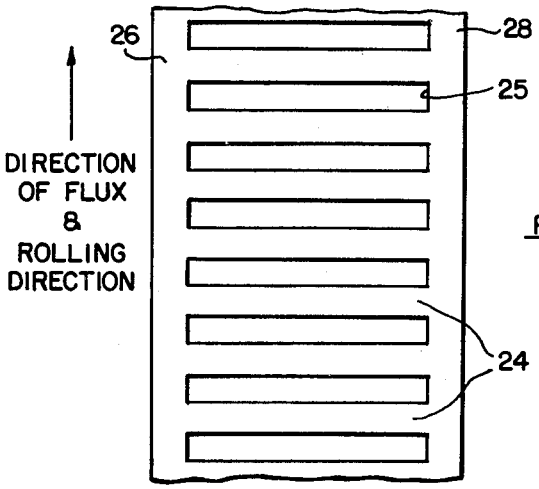
PRIOR ART FIG.6.
FIG. 6 is a fragmentary elevational view of the laminated structure of prior art construction.

A description of the prior art configuration is shown in FIG. 6. It is constructed in an integrated manner by punching the opening means into steel strip and stacking a plurality of laminations into a core and fastening together with adhesives, clamps, welds, or any other suitable means. In this structure, the laminations are blanked in such a manner that the flux flow is in a direction parallel to the plane of the lamination and the direction of rolling, but perpendicular to the air gaps. When a core of the web structure of FIG. 6 is placed between hgh permeability yokes for completion of the flux paths in the magnetic circuit, the web sections of the core are easily magnetized and will exhibit saturation at a magnetizing field of approximately 100 oersteds. Thereafter, at fields above 100 oersteds, the magnetization curve exhibits extremely linear characteristics until the material in the rib section of the core begins to saturate. The linear portion of the curve ranges from $B_r$ to $B_m$ as shown in the hysteresis loop of FIG. 5. The span of the linear range for 3% grain-oriented silicon steel is approximately 20 kilogausses.

Figure 7:
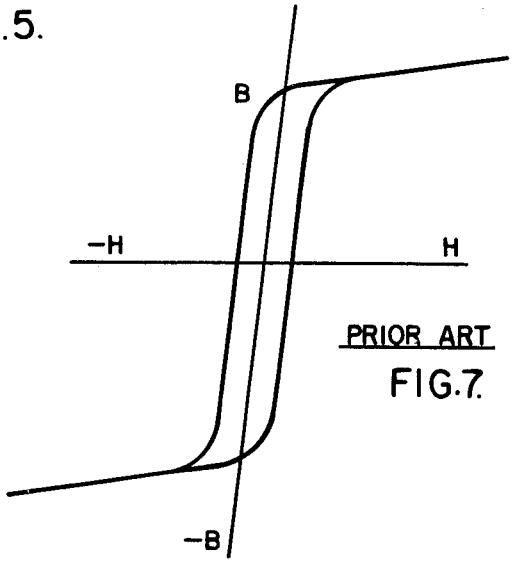
PRIOR ART FIG.7.
FIG. 7 is a graph of a tyical non-linear ferromagnetic material.

By placing a DC bias on a core of prior art structure, as shown in FIG. 6, the core operates as a linear inductor over the range of approximately $\pm Bs/2$ (or $\pm 10$ kilogausses for 3% steel). For purposes of comparison, a typical hysteresis loop of a non-linear ferromagnetic core is shown in FIG. 7. In the curve of FIG. 5 the finite value of $B_r$ is determined by the width of the web section of the core, in relation to the total width of the lamination or core, as shown in the following Table 1:

TABLE 1

| Width of Lamination | Width of Web (1 side) | Total Web (%) | $B_r$ (Kilogausses) |
|---|---|---|---|
| 2.0" | 0.125" | 12.5 | 2500 |
| 2.0" | 0.250" | 25.0 | 5200 |
| 2.0" | 0.375" | 37.5 | 8000 |

In general, the residual induction, $B_r$, is equal to the web width percentage (as a decimal) times the saturation value, Bs, of the material. The slope (or differential permeability) of the linear portion of the curve, $\Delta B/\Delta H$, is a function of the air gap and rib lengths, as shown in Table 2:

TABLE 2

| % Air Gap | % Rib | Slope (Or Differential Permeability, $\mu_d$) ($\Delta B/\Delta H$) |
|---|---|---|
| 36 | 64 | 3.0 |
| 46 | 54 | 2.3 |
| 56 | 44 | 1.8 |

The larger values of Ud are attainable by using smaller air gaps; however, as gaps become smaller and smaller, the curve begins to show non-linear characteristics.

Laminations for the web core are blanked from the same material as that used in the yoke section of the core. If desirable, the web core may utilize the cruciform structure as used in power transformer construction.

Figure 8:
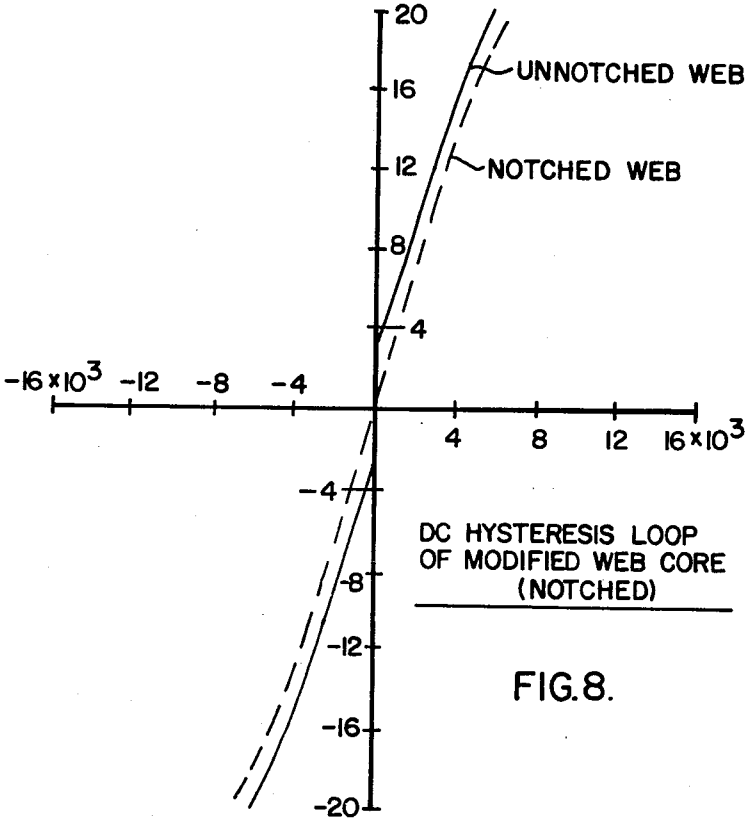
FIG. 8 is a graph of a hysteresis loop for notched and unnotched web cores.

The web core design and performance characteristics shown in FIGS. 5 and 6 may not be desirable for reactor cores. Generally, shunt reactor cores require linear magnetization characteristics (or linear E (voltage) vs. I (current) characteristics) over the full range of the hysteresis loop. FIG. 4 shows the method of this invention for obtaining the full linear characteristics. The embodiment in FIG. 4 was modified by insertion of the notches 27 into the web section of the core. These notches extend horizontally into the previously described rib section of the core. These notches provide series air gaps in the web section of the core which eliminates the finite value of residual induction, $B_r$, and causes the hysteresis loop to pass through the origin, as shown in FIG. 8. FIG. 8 shows a comparison between a notched core and the same core without notches. Thus, the notches reduce the residual induction to zero by causing a nearly parallel shift of the B vs. H curve. This change in characteristics allows the modified web core (FIG. 4) to be used in shunt reactor cores; whereas, in the web core structure a DC bias was required to utilize the linear magnetization characteristics. Differential permeabilities of 3 or higher are attainable; consequently, this design can be used to great advantage in reducing weight and volume of shunt reactor cores.

Figure 9:
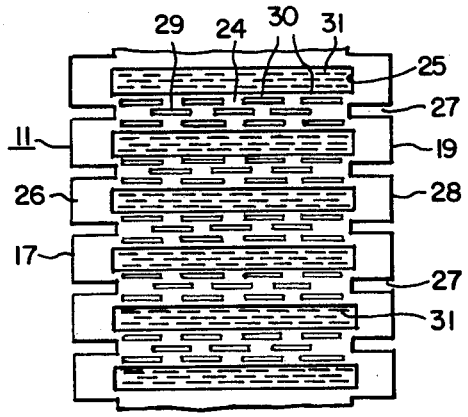
FIG. 9 is a fragmentary view of a web core with microlamination inserts.

FIG. 9 shows another modification in the web core embodiment which includes small rectangular horizontally oriented slits 29, 30 in the rib 24. The purpose of these slits 29, 30 is to reduce eddy current losses due to leakage flux by isolation of eddy current paths. The slits 29, 30 necessitate a compensating reduction in main air gap size. The magnetization characteristics of this core is identical to the curve of FIG. 8; however, core loss is significantly reduced due to reduced eddy currents in the plane of the ribs.

Figure 10:
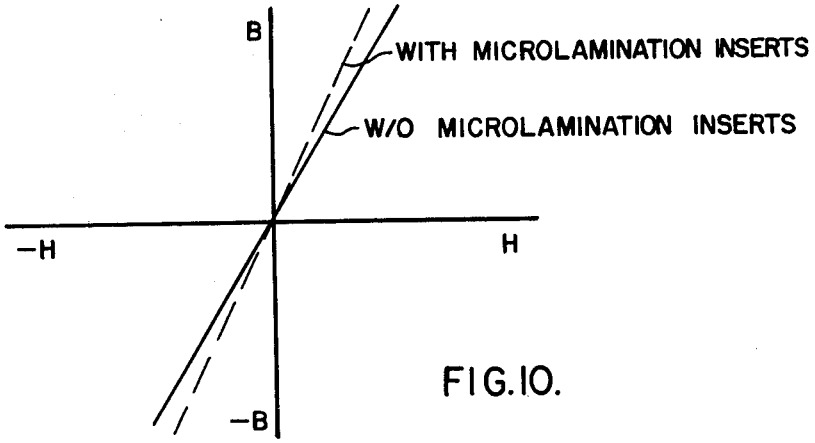
FIG. 10 is a graph of the hysteresis loop for the embodiments of FIG. 9.

FIGS. 1, 9 show an embodiment of the web core in which thin rectangular steel particles comprised of compressed, annealed, insulated, and bonded microlaminations 31 are inserted into the main air gaps of the web core embodiment. The microlamination compacts can be molded in such a way as to control the permeability and maintain linearity in the compacts per se. The insertion of microlaminations in the web core's main air gaps will effectively increase the inductance of the core while simultaneously maintaining the desired linearity. This is accomplished by adjusting the permeability of the microlamination inserts to be slightly greater than that of air or free space, but packed at a sufficient density to carry the leg core flux without saturation. This embodiment has the combined advantages of minimizing or eliminating flux leakage at the air gaps while increasing the inductance of the core. An example of the improvement with this embodiment is shown in FIG. 10. The permeability is improved while linear B vs. H characteristics are still maintained. Permeabilities in excess of $\mu=3$ are possible.

It is recognized that high reluctance linear cores can be constructed by use of microlaminations alone, as taught in U.S. Pat. Nos. 3,848,331; 3,948,690; 4,158,561; 4,158,580; 4,158,581; and 4,158,582. Microlaminations are processed steel particles suitable for compaction in AC or DC magnetizable compacts. The particles are cut by various methods into small, substantially elongated, rectangular-shaped parallelopipeds which may be annealed and insulated when required. The geometry of the microlaminations are approximately 0.080"×0.020"×0.002". Cores compacted from microlaminations have been found to exhibit a wide range of magnetic properties depending on compaction pressure, particle orientation, particle geometry, binding medium, insulation, and residual stresses. Microlaminations provide a distributed air gap for minimization of leakage flux and noise while simultaneously providing the required inductive characteristics.

Figure 11:
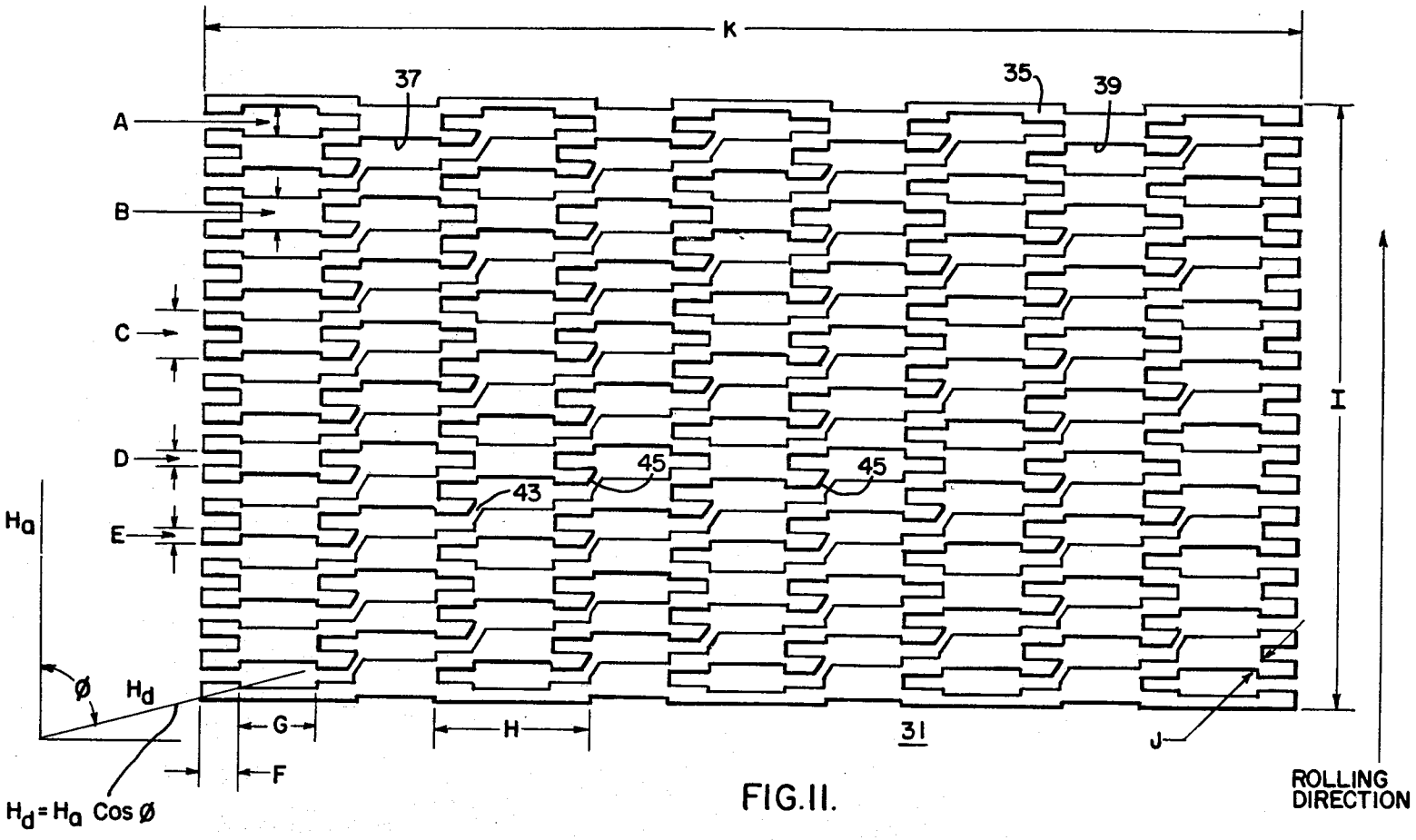
FIG. 11 is an elevational view of a web core of another embodiment.

The grid sheet of FIG. 11 comprises a thin sheet 35 of ferromagnetic material that contains a plurality of evenly distributed air gaps 37, 39 that are mechanically punched or chemically blanked in the form of a continuous grid. The grid laminations may be assembled into cores 41 (FIG. 12) by aligning the slots and the grids then stacking in conventional manner and holding the grid laminations into an integral core by resin bonding, welding, or by using any other acceptable core building technique. The construction of the shunt reactor core may then be completed by inserting one (or two) grid cores between low loss laminated yokes which serve as flux return paths. The completed shunt reactor core is characterized by high relunctance and linear B vs. H (or E vs. I) to give sine wave reactive currents without harmonics. The gaps 37, 39 and grids of the laminated grid are controlled in size and geometry to yield the desired magnetic characteristics. A $1\frac{3}{4}$"×1"×0.004" section of a laminated grid 35 (FIG. 11) has a 40% air gap. The interacting effect of air gap size, grid size, and permeability are shown in Table 3 in conjunction with the lettered dimensions of FIG. 11:

TABLE 3

Four Laminated Grid Designs Chemically Blanked from .004" Grain Oriented Electrical Steel

| % Air Gap | Permeability (U @ 13 kG) | Grid Ident. | Dimensions, inches A | B | C | D | E | F | G | H | I | J | K |
|---|---|---|---|---|---|---|---|---|---|---|---|---|---|
| 50 | 2.2 | No. 1 | .050 | .050 | .075 | .025 | .025 | .0625 | .125 | 0.250 | .9750 | .0125 | 1.75 |
| 45 | 2.5 | No. 2 | .045 | .055 | .0775 | .0225 | .0275 | .0625 | .125 | 0.250 | .9775 | .01625 | 1.75 |
| 40 | 2.9 | No. 3 | .040 | .060 | .080 | .020 | .030 | .0625 | .125 | 0.250 | .9800 | .0200 | 1.75 |
| 35 | 3.5 | No. 4 | .035 | .065 | .0825 | .0175 | .0325 | .0625 | .125 | 0.250 | .9825 | .02375 | 1.75 |

Figure 13:
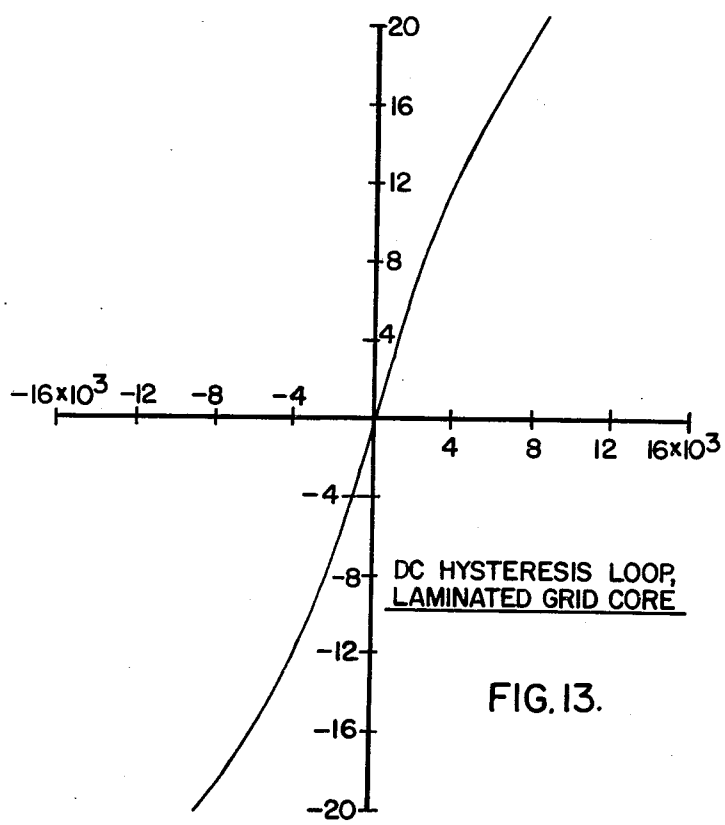
FIG. 13 is a graph of a hysteresis loop of a laminated grid core.

A matrix consisting of 50% air gap-50% grid yields a permeability at 13 kG of 2.2 while a 35% air gap-65% grid yields a permeability of 3.5. However, the latter ($\mu=3.5$) has a somewhat poorer linearity than the former. The optimum compromise of permeability vs. linearity occurs at 40–45% air gap and 60–55% grid. An example of such a curve is shown in FIG. 13. In this case, the permeability $\mu=3.0$ at 13 kG.

In the lamination grid embodiment the lamination grid has the integrity of a continuous sheet, yet it contains the desired air gaps in series with the flux. This is accomplished, in part, by the strategic location of diagonal slots 43, 45 (FIG. 11) which are required in the matrix to prevent the flow of continuous flux through the grid. The size of the diagonal air slots 43, 45 is substantially smaller than that of the main air gaps 37, 39 in the matrix. The air gap length of the diagonal air slots 43, 45 (FIG. 11) is a function of the angle ($\phi$) which is formed by the vector of the applied field ($H_a$) and its cosine component, ($H_d=H_a \cos \phi$), which tends to produce flux in the diagonal direction. For the example of FIG. 11, the angle $\phi$ is equal to 75° and its cosine is 0.26. Thus, the diagonal air gaps shall be 0.26 times that of the main air gaps in the matrix.

In FIG. 11, which consists of 40% air gap and 60% grid, the main gap length is 10 times the "A" dimension or 0.4 inch per inch of core length. Consequently, the effective diagonal air gap is 0.26×0.4 inch/inch=0.104" per inch of core length. The gap length of each diagonal slot in the matrix, then is 0.104 inch/inch divided by the number of slots per column. Thus, for a column containing 5 diagonal slots, the diagonal gap length is 0.104/5=0.0208 inch. For a column of 10 diagonal slots, gap length is 0.104/10=0.0104". This method of design produces equal magnetic reluctance across the entire width of the grid lamination.

In the laminated grid embodiment the leakage eddy current losses are controlled by the geometry and size of grids. These losses are primarily governed by the size of dimensions "B" and "G" in the matrix, that is, the larger the "B" and "G" dimensions, the larger the leakage eddy current losses. In particular, the sizes of the grid of FIGS. 11 and 12 were designed to give low losses in accordance with the formula:

$$P_e lb = 0.0627 \times a^2 b^2 / a^2 + b^2 \times B^2 f^2 / pxd$$

where a=dimension "B" (cm)

b=dimension "G" (cm)

B=normal component of leakage induction (kilogausses)

f=frequency, (Hz)

p=electrical resistivity (U-Ω-cm)

d=density (g/cc).

Thus, the core leakage losses for the design of FIG. 11 are: $P_e$lb=0.0058×$B^2$ for 3% silicon steel and $P_e$/lb=0.023×$B^2$ for low carbon steel, assuming f=60, P=48 and 12, d=7.65 and 7.85, for 3% SiFe and low carbon steel, respectively. In accordance with this, at an assumed leakage induction of B=2 kilogausses, the leakage eddy current loss, $P_e$/lb, is 0.023 watt/lb for 3% SiFe steel and 0.092 watts/lb for low carbon steel. Consequently, in view of these low losses, the grid dimensions are not restricted to the dimensions in FIG. 11. As an example, in practice it may be more feasible on the basis of economics and structural strength to double the size of the grid dimensions, in which case $P_e$/lb=0.092 watts/lb for 3% SiFe and $P_e$/lb=0.36 watts/lb for a low carbon steel, at an assumed leakage induction of B=2 kilogausses.

In the design of FIG. 11, it should be recognized that the "lamination grid" is designed so that the direction of flux flow is in a direction of preferred orientation. In grain oriented 3% silicon steels of orientation, {011} <100>, the direction of lowest core loss is in the rolling direction as shown in FIG. 11. An example of the core loss for various materials and thicknesses are shown in Table 4:

TABLE 4

| Material | Thickness (in) | Core Loss @ 13 kG, 60 Hz, watts/lb |
|---|---|---|
| Low Carbon Steel | 0.002 | 0.90 |
| (AiSI 1010) | 0.004 | 1.1 |
| 3% Grain Oriented | 0.002 | 0.48 |
| Oriented | 0.004 | 0.44 |
| Silicon | 0.006 | 0.40 |

TABLE 4-continued

| Material | Thickness (in) | Core Loss @ 13 kG, 60 Hz, watts/lb |
|---|---|---|
| Steel | 0.011 | 0.36 |

The lamination grid cores may be constructed from a number of ferromagnetic materials utilizing a variety of thicknesses. However, the preferred material is grain oriented 3% silicon steel of texture {011} <100>, wherein the grid is designed so that the flux flow is in the <100> direction. The preferred thickness is 0.004–0.006 by reason of low core loss, as shown, and for ease and precision of chemical blanking.

The grid laminations (FIG. 11) as previously described may be blanked from thin ferromagnetic sheets or strip by mechanical or chemical techniques. If blanked by mechanical methods, the lamination grids should be deburred and stress relief annealed prior to stacking to minimize core loss. If the grids are chemically blanked, no anneal or burr grinding is required since this process gives a stress-free punching without burrs. An interlaminar insulation is required on the punchings to minimize interlaminar losses.

Figure 12:
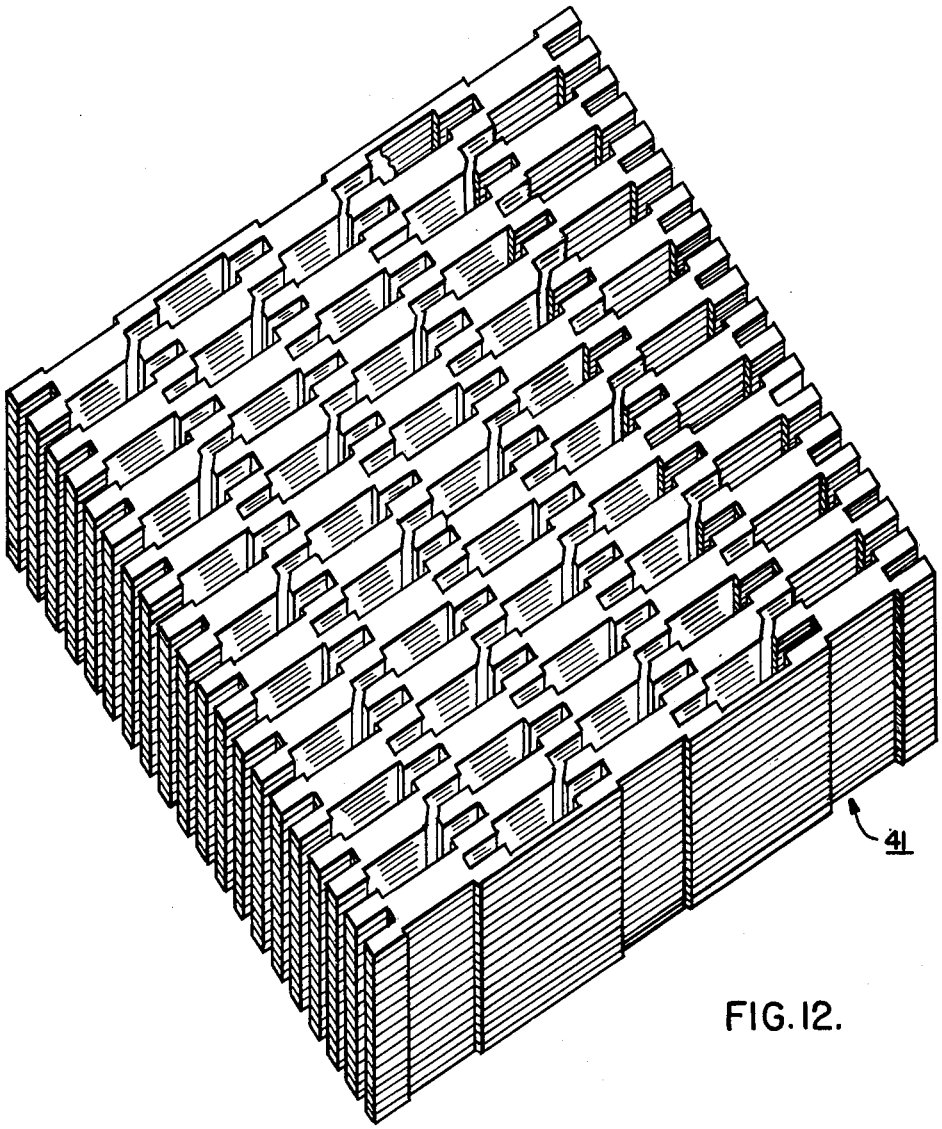
FIG. 12 is an isometric view of a grid core comprised of laminations of FIG. 11.

The laminated grid core of FIG. 12 was constructed by stacking uncoated grid laminations in a molding container so that grid and air gaps of all laminations were in perfect alignment. The loose stack was then saturated with a thin epoxy resin, pressed at 5000 psi into a tight core, and cured at R.T. during application of load. This results in a tight core having a lamination space factor of 95%. The thin epoxy resin serves three functions, (1) an interlaminar insulating medium, (2) a bonding medium for core strength, and (3) a sound damping medium.

The shunt reactor grid core (FIG. 12) has an advantage over the conventional wheel design in that the cross-sectional packing factor is 95% compared to approximately 80%. This means that the grid core can carry 18% more flux, and this (combined with higher attainable permeabilities, $\mu=3$ vs. $\mu=2$) will permit higher operating flux density. This, in turn, will allow for smaller core size and corresponding reductions in core winding size. This results in overall smaller reactor mass and size profile.

The lamination grid core is also advantageous relative to the wheel design in that it contains a large number of distributed air gaps, approximately 40 gaps per inch versus one (1) gap per inch. This means that the $B^2A$ forces at the gaps will be distributed throughout the core, resulting in small vibrations and lower noise levels.

The distributed air gap will also minimize the leakage of flux from the core to the surrounding windings, thereby reducing stray losses in the windings as well as leakage losses in the core itself. Further, the flux which does leak from the core will have minimal effects since the eddy currents are relatively isolated by the grid network.

In conclusion, core of this invention provides the B vs. H linearity that permits the voltage and power stability required for shunt reactors with the added advantages of structural integrity, higher permeability with smaller core size, better packing factor, and higher induction.

What is claimed is:

1. A laminated-magnetic core comprising:

(a) spaced core yokes;

(b) core legs disposed between the core yokes;
(c) each core yoke and core leg being comprised of stacked laminations of magnetic material;
(d) each leg including opposite edge walls and opposite web side walls extending between upper and lower core yokes;
(e) the web side walls having opening means comprising a plurality of spaced elongated apertures and edge notches;
(f) the apertures having longitudinal axis disposed transversely to the longitudinal axis of the core legs;
(g) the notches extending from the edge walls and into the web side walls between the apertures; and
(h) the opening means extending through the laminations of the core legs between the web side walls, whereby linear magnetization characteristics are obtained over the entire hysteresis loop.

2. The core of claim 1 in which the apertures are disposed in vertically spaced horizontal zones of each other with transverse web side wall portions therebetween, said side walls portions extending between opposite edge walls, and the notches being in said side wall portions and extending from each edge wall and between the apertures.

3. The core of claim 2 in which the elongated apertures are rectangular and have opposite ends aligned with corresponding ends of adjacent apertures and in planes spaced inwardly from and parallel to the corresponding edge walls.

4. The core of claim 3 in which the notches extend partially between adjacent pairs of apertures.

5. The core of claim 4 in which the opening means also comprise a plurality of spaced elongated slits in the web side wall portions between each adjacent pair of apertures to dispel eddy current.

6. The core of claim 5 in which the spaced elongated slits are aligned with the corresponding notches.

7. The core of claim 6 in which the apertures are filled with microlamination compacts for increasing permeability and reducing leakage flux.

8. The core of claim 3 in which the apertures are disposed in parallel rows with the apertures in some rows being interconnected to apertures in next adjacent rows.

9. The core of claim 8 in which the opening means comprise from about 35% to about 50% of the lamination surface to effect an optimum permeability vs. linearity characteristic.

10. The core of claim 9 in which the opening means is about 50% of the lamination surface for a permeability of 2.2.

11. The core of claim 9 in which the opening means is about 40% to 45% to attain a permeability of 3.0.

* * * * *